US006835903B1

(12) United States Patent
Liu et al.

(10) Patent No.: US 6,835,903 B1
(45) Date of Patent: Dec. 28, 2004

(54) AUTOMATIC LOCKING AND RELEASING STRUCTURE FOR PUSH-PULL PLUG

(75) Inventors: Ke-Chih Liu, Taipei (TW); Jeng-Je Pan, Taipei (TW); Cho-Liang Liang, Taipei (TW)

(73) Assignee: Ahoku Electronic Company, Taipei (TW)

( * ) Notice: Subject to any disclaimer, the term of this patent is extended or adjusted under 35 U.S.C. 154(b) by 0 days.

(21) Appl. No.: 10/835,954

(22) Filed: Apr. 28, 2004

(51) Int. Cl.[7] ..... H01R 13/70
(52) U.S. Cl. ..... 200/43.02; 200/293; 439/131
(58) Field of Search ..... 200/43.02, 293, 200/297, 296, 238, 252; 439/131, 172, 103, 166

(56) References Cited

U.S. PATENT DOCUMENTS 5,220,152 A * 6/1993 Doran ..... 219/201
5,507,162 A * 4/1996 Chhatwal ..... 70/278.3
5,516,305 A * 5/1996 Haluska ..... 439/484
5,847,540 A * 12/1998 Burns et al. ..... 320/107
6,042,400 A * 3/2000 Queffelec et al. ..... 439/131
6,062,880 A * 5/2000 Skuza ..... 439/131

* cited by examiner

*Primary Examiner*—Kyung S. Lee

(57) ABSTRACT

The automatic locking and releasing structure for a push-pull plug of this invention includes an upper case, a bottom case, a slider and push-buttons. The bottom case is suspended therein with two symmetrically arranged slide tracks that are each provided at the inside thereof with a wedge piece. The opposing sides of the slider are each formed with a resilient retaining arm, and the slider is movably provided between the two slide tracks. The free ends of the resilient retaining arms are movably attached to the push-buttons provided at the outside of the slide tracks. As such, when one manipulates the push-buttons to move along slide slots formed in the upper case and bottom case, the slider may be retracted or extended at the same time thereby subjecting the resilient retaining arms to assume a locking or releasing state with respect to the wedge pieces.

6 Claims, 6 Drawing Sheets

AUTOMATIC LOCKING AND RELEASING STRUCTURE FOR PUSH-PULL PLUG

FIELD OF THE INVENTION

This invention relates to a design of an automatic locking and releasing structure for a push-pull plug, particularly relates to a structural design for one where the conductive blades of the plug may be automatically locked in place and released to recover while adjusting the conductive blades to retract or extend.

BACKGROUND OF THE INVENTION

It is found that the structural assembly of the conventional universal adaptor is provided with a plurality of sets of conductive blades of different configurations on the plug body, such that each set of conductive blades are embedded in the plug in a retracting or wrenching manner. Accordingly, the user may select one set of conductive blades in accordance with the power outlet specification at a desired country in using plug, while the remaining sets of conductive blades are concealed in the plug body. As such, the plug may be adapted to various power outlet specifications by adjusting the position of each set of the conductive blades.

The retracting structure of the conductive blades for the aforementioned universal adaptor (as shown in FIGS. 1 and 2) includes: conductive blades 10 provided on a slider 20; urging tabs 201 affixed to two sidewalls of the slider 20, such that the urging tabs 201 are able to act on push-buttons 30 provided on the outside of the slider 20 (as shown in FIG. 3), the push-buttons 30 being releasably engaged in slots 40 formed on the plug and restrained in place by a stop pieces 401 formed at the inside of the slots 40. When a user intends to adjust the state of the conductive blades 10, he needs to press the push-buttons 30 to disengage the push-buttons 30 from a state that is stopped and retrained by the stop pieces 401, to consequently cause displacement of the slider 20 driven by the push-buttons 30, such that when the conductive blades 10 are adjusted to the desired position, the user would release the force applying against the push-buttons 30 such that the push-buttons 30 are able to assume a state that urges against the stop pieces 401 under the influence of the urging tabs 201 (as shown in FIG. 4).

However, when the user does not understand the proper procedure for adjusting the conductive blades 10, he would intuitively and directly push and slide the push-buttons 30 to perform the adjusting operation. The intuitive operation would damage the stopping structure between each of the push-buttons 30 and stop pieces 401 as time passes to a least extent that would result in poor positioning of the conductive blades 10, or a severe extent that would result in complete malfunctions of the conductive blades 10.

In view of the shortcomings of the prior art, the inventor of this invention made improvements and invented an automatic locking and releasing structure for push-pull plug that is designed in consideration of the human factors and operational habits of the ordinary users, where the locking or releasing operations may be accomplished automatically while performing the adjusting operation by retracting/extending the conductive blades without damaging the structure.

SUMMARY OF THE INVENTION

The primary objective of this invention is to provide an automatic locking and releasing structure for a push-pull plug, where the conductive blades of the plug may be automatically locked in place and released to recover upon retracting or extending push-buttons.

To achieve this objective, this invention includes an upper case, a bottom case, a slider and push-buttons. The bottom case is suspended therein with two symmetrically arranged slide tracks that are each provided at the inside thereof with a wedge piece. The opposing sides of the slider are each formed with a resilient retaining arm, and the slider is movably provided between the two slide tracks. The free ends of the resilient retaining arms are movably attached to the push-buttons provided at the outside of the slide tracks. As such, when one manipulates the push-buttons to move along slide slots formed in the upper case and bottom case, the slider may be retracted or extended at the same time thereby subjecting the resilient retaining arms to assume a locking or releasing state with respect to the wedge pieces.

It is a further objective of this invention to provide an automatic locking and releasing structure for a push-pull plug, wherein the wedge pieces are each formed of an inclined configuration along the inside of the respective slide tracks such that when the slide tracks are driven by the slider to move upwards, the resilient retaining arms provided on opposing sides thereof are able to enter stopping faces formed on tops of the wedges piece along the inclined faces of the wedge pieces, subjecting the slider to be locked in place.

It is another objective of this invention to provide an automatic locking and releasing structure for push-pull plug, where the push-buttons are each formed on opposing sides of an urging plate thereof with inclined guide slots of an inclined configuration in such a manner that the inclined guide slots are correspondingly attached to opposing sides of the free ends of the resilient retaining arms, and capable of pushing the slider to move upwards. However, when the push-buttons slide downwards, the inclined guide slots are able to push the resilient retaining arms inwards to disengage from the stopping faces of the wedge pieces thereby releasing the slider.

BRIEF DESCRIPTION OF THE DRAWINGS

These and other modifications and advantages will become even more apparent from the following detained description of a preferred embodiment of the invention and from the drawings in which.

DETAILED DESCRIPTION OF THE PREFERRED EMBODIMENTS

Figure 1:
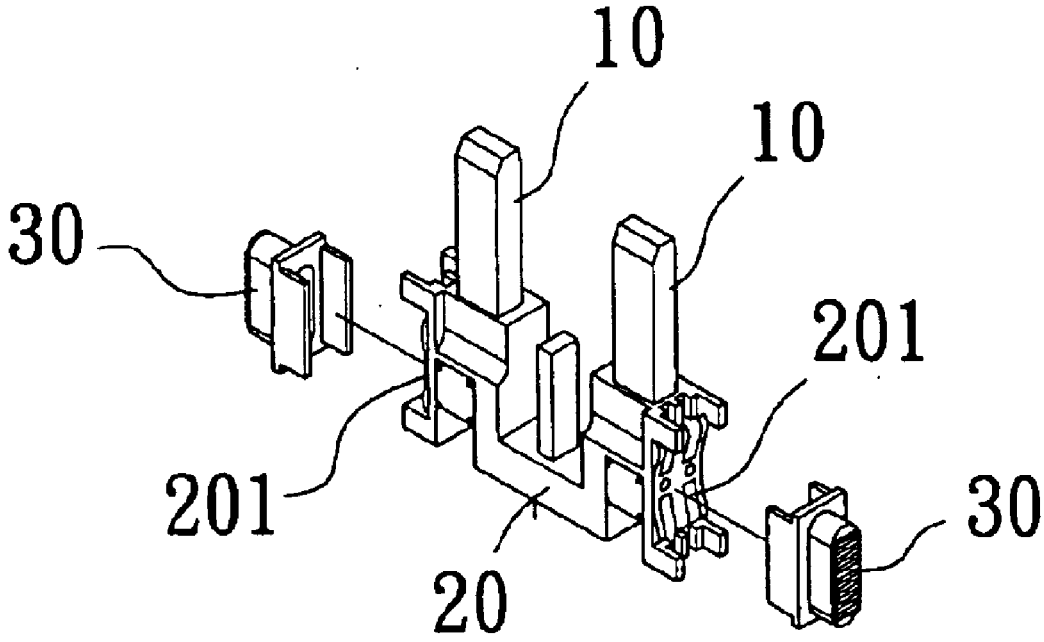
(PRIOR ART) Fig. 1
FIG. 1 illustrates a partial, exploded, perspective view a conventional push-pull plug.
Figure 2:
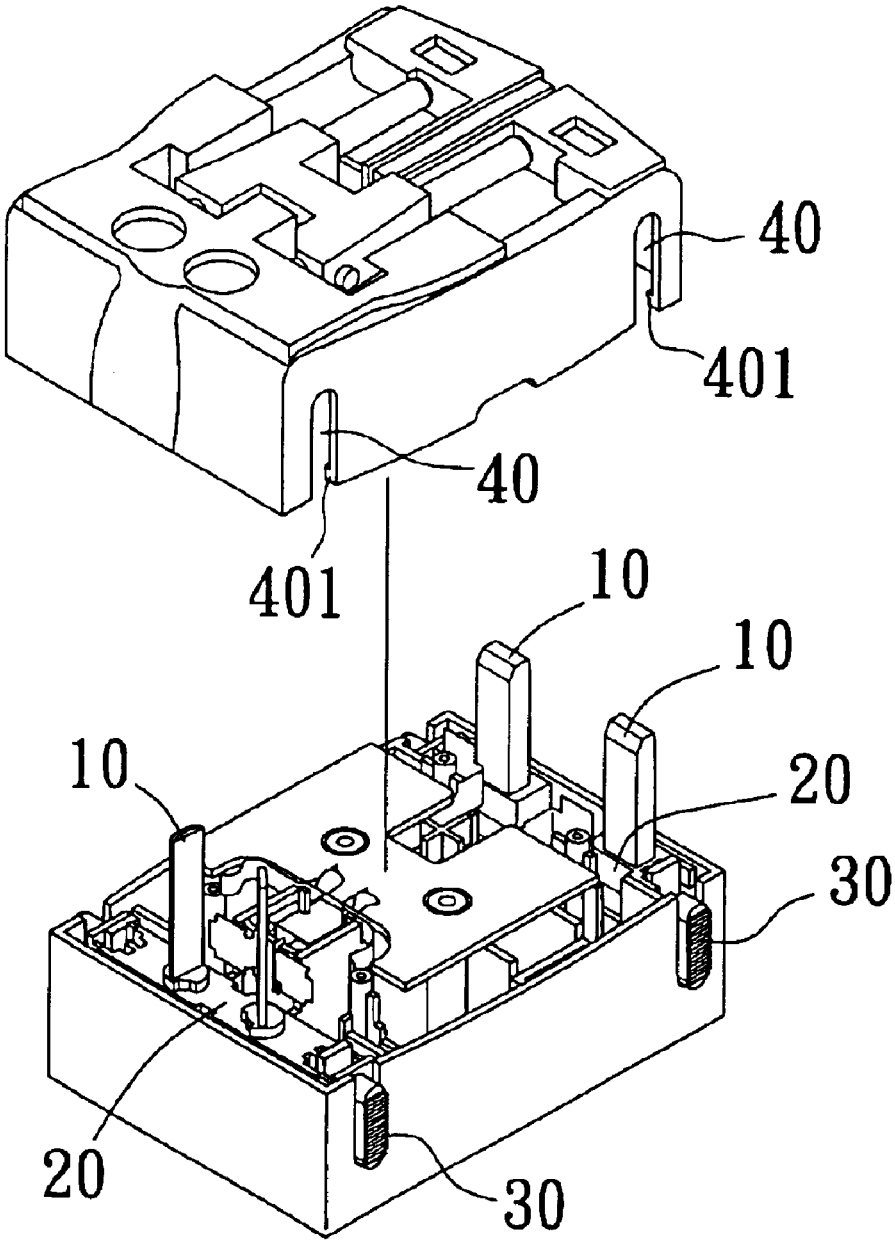
(PRIOR ART) Fig. 2
FIG. 2 illustrates an assembled, perspective view of a conventional push-pull plug.
Figure 3:
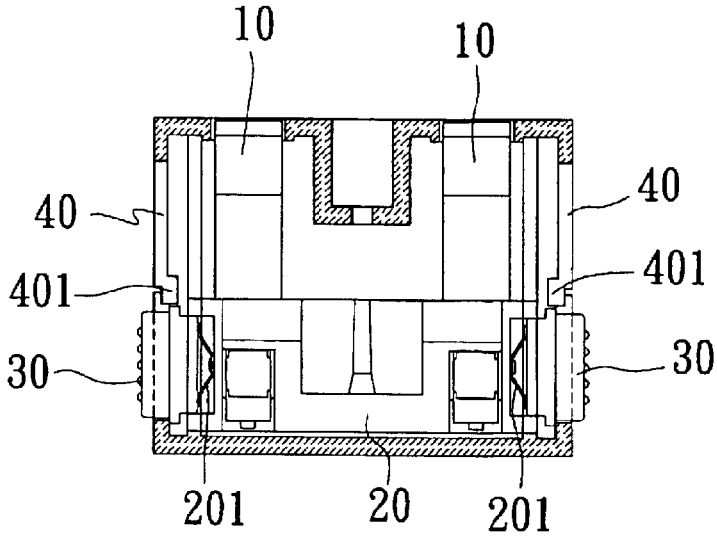
(PRIOR ART) Fig. 3
FIG. 3 illustrates an assembled, cross-sectional view of a conventional push-pull plug (where the conductive blades are retracted inwards).
Figure 4:
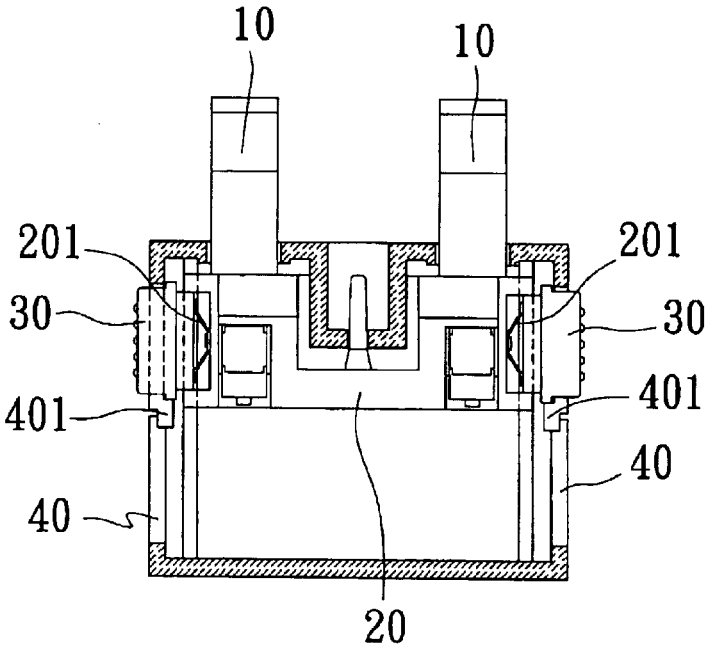
(PRIOR ART) Fig. 4
FIG. 4 illustrates another assembled, cross-sectional view of a conventional push-pull plug (where the conductive blades are extended outwards).
Figure 5:
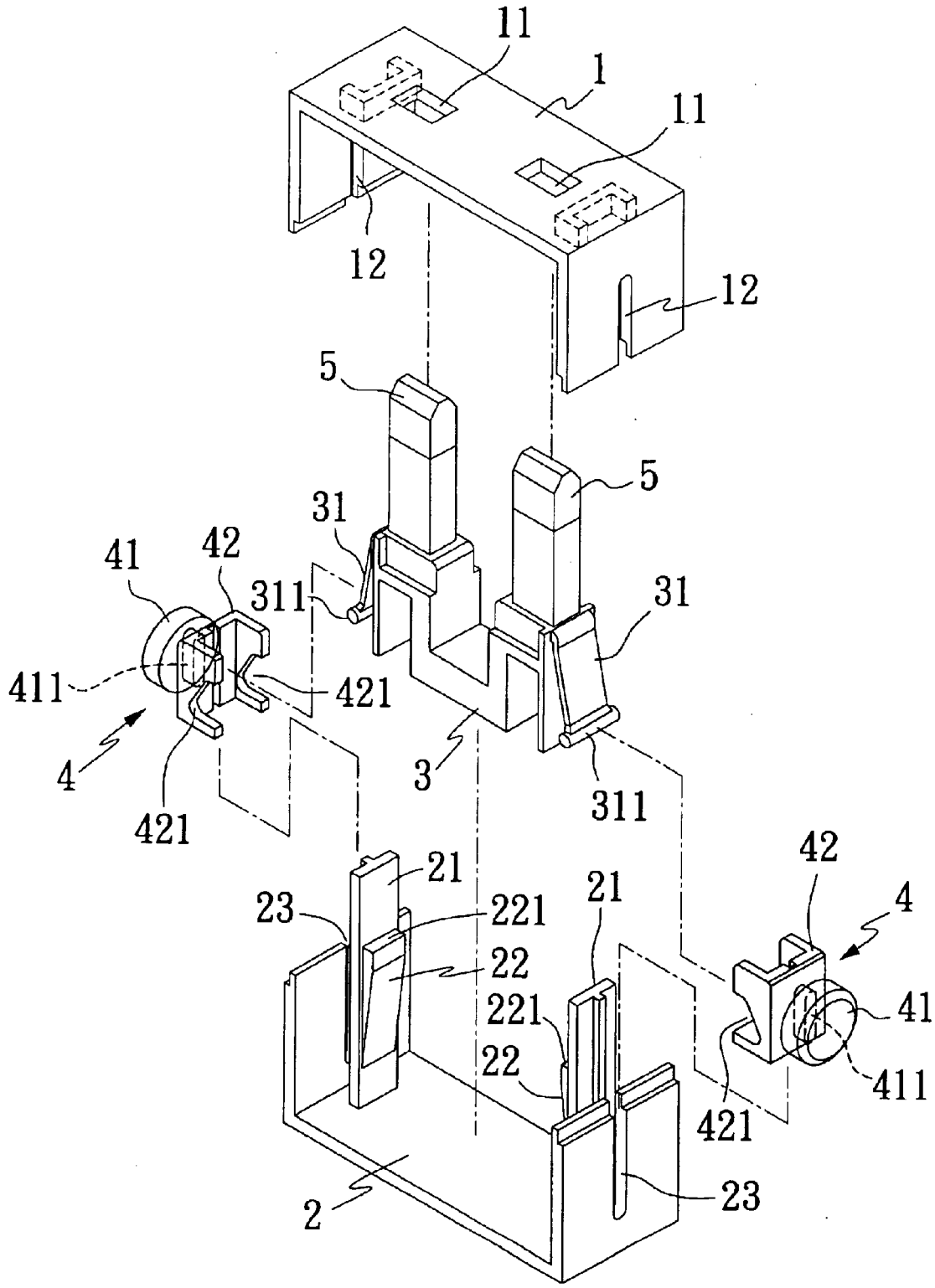
FIG. 5 illustrates an exploded, perspective view of this invention.

FIG. 5 illustrates an automatic locking and releasing structure for a push-pull plug of this invention, comprising: an upper case 1, a bottom case 2, a slider 3 and push-buttons 4.

The upper case 1 is joined to the bottom case 2 and serves as a lid of a plug body. On a top face of the upper case 11 is formed with apertures 11 that are of a number corresponding to the conductive blades 5 and dimensioned to correspond to the cross-section of the conductive blades 5. On opposing sidewalls of the upper case 11 are each formed with a slide slot 12.

The bottom case 2 is joined to the upper case 1 and serves as a base of the plug body. The bottom case 2 is suspended therein with two symmetrically arranged slide tracks 21 that are each provided at a designated location of an inner end thereof with a wedge piece 22. The wedge pieces 22 are each formed of an inclined configuration along the inside of the respective slide tracks 21 and with a stopped face 221 on a top thereof. The bottom case 2 is formed on opposing sidewalls thereof with slide slots 23, such that when the bottom case 2 is joined to the upper case 1, their slide slots 12, 23 align with each other.

The slider 3 includes a base for affixing and supporting conductive blades 5. On opposing sides of the base are each formed with a resilient retaining arm 31 at the outside of the slider 3 in an inclined and flared configuration. The resilient retaining arms 31 are each laterally formed with a guide post 311 at a free end thereof.

The push-buttons each 4 include an outer actuator 41 and a liner 42. The outer actuator 41 is provided at the inside thereof with a reduced neck 411 that is connected to the liner 42. The reduced neck 411 has a thickness that adapts to a width of the slide slots 12, 23. The liner 42 is provided on opposing sidewalls thereof with inclined guide slots 421 each formed of an inclined configuration.

Figure 6:
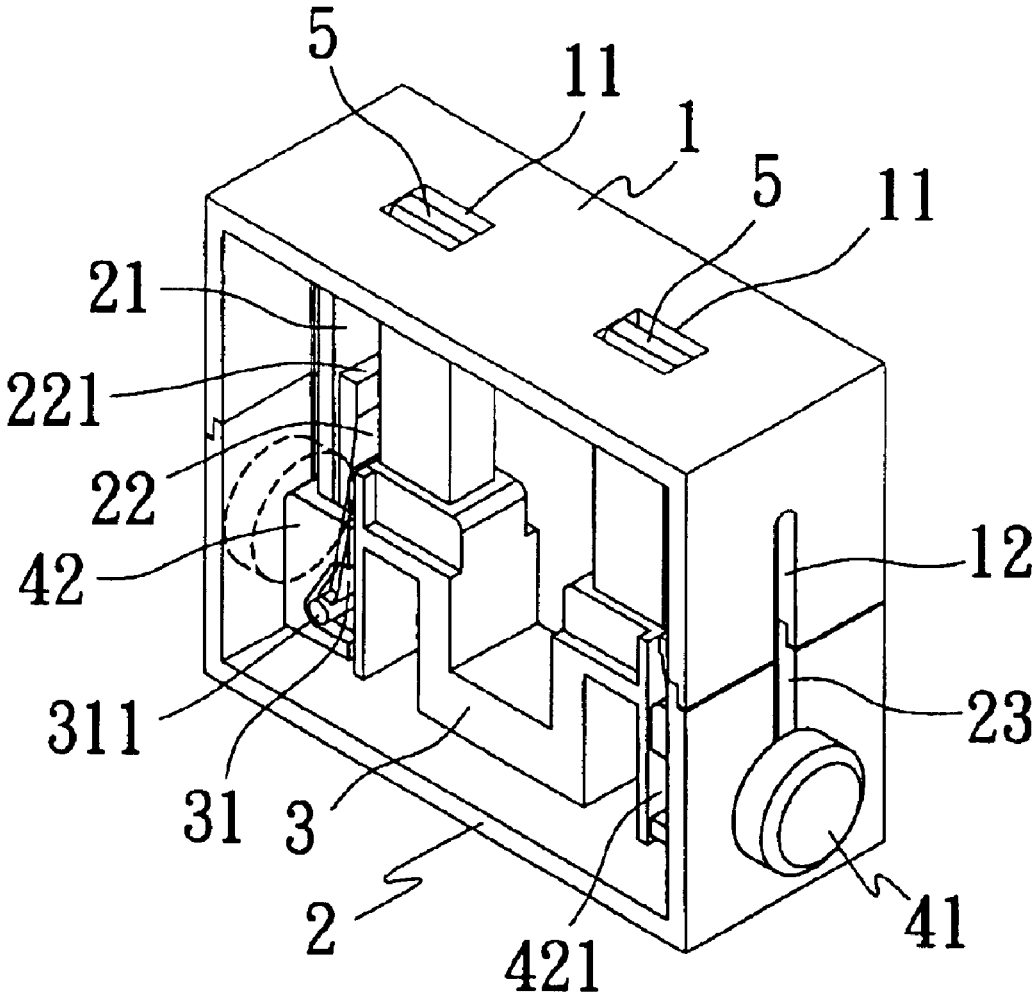
FIG. 6 illustrates an exploded, perspective view of this invention.

With the above components, as shown in FIG. 6, the slider 3 is first placed in the bottom case 2 and movably provided between the two slide tracks 21. The reduced necks 411 of the push-buttons 4 are then each engaged into the respective slide slots 2 in such a manner that the liners 42 of the push-buttons 4 each straddle over the respective slide tracks 21 and that the opposing inclined guide slots 421 are movably attached to the guide posts 311 of the respective resilient retaining arms 31. The upper case 1 is then joined to the bottom case 2, such that upon pushing and sliding the push-buttons 4, the inclined guide slots 421 would automatically guide the resilient retaining arms 31 to match with the respective wedge pieces 22 thereby assuming a locking or releasing state.

The states of the automatic locking and releasing structure for push-pull plug of this invention in actual operation are described as follows.

Figure 7:
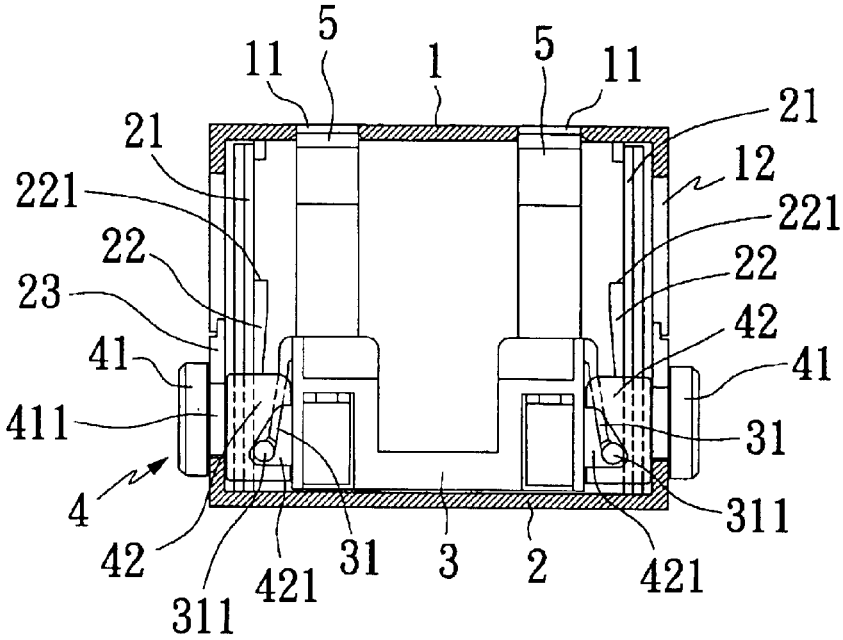
FIG. 7 illustrates an assembled, cross-sectional view of the invention (where the conductive blades are retracted inwards).

When the slider 3 supports the conductive blades 5 to be concealed in an enclosure formed by the upper case 1 and bottom case 2, the slider 3 is located at a bottom of the slide tracks 21 of the bottom case 2. Under such circumstances, the opposing resilient retaining arms 31 are flared outwards due to absence of external forces. The guide posts 311 located on the free ends of the resilient retaining arms 31 are attached to the inclined guide slots 421, and the outer actuators 41 of the push-buttons 4 are each wedged at the outside of the respective opposing slide slots 23 of the bottom case 2 (as shown in FIG. 7).

Figure 8:
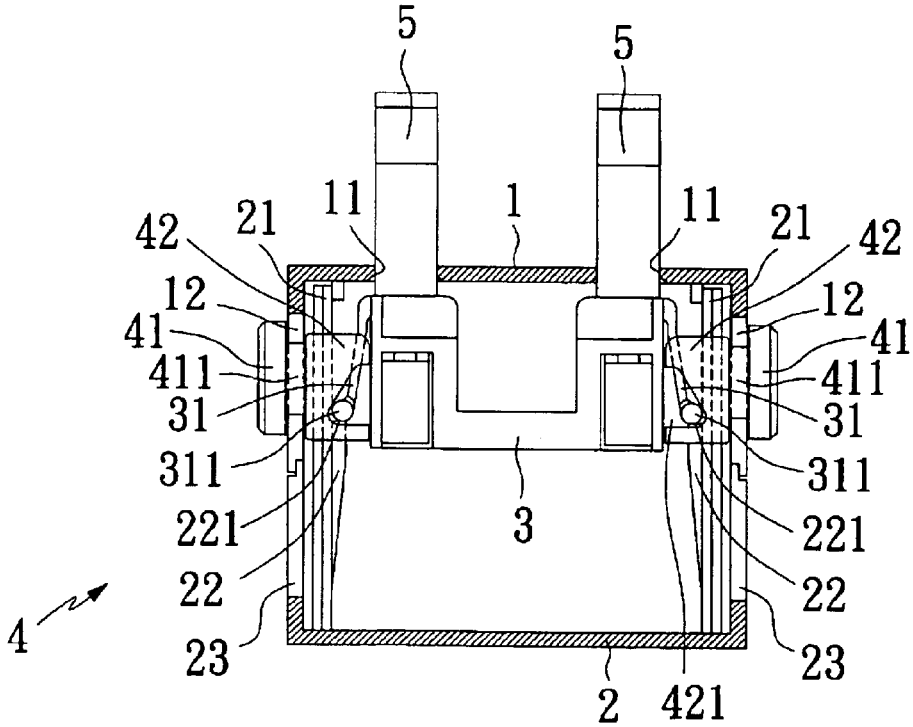
FIG. 8 illustrates another assembled, cross-sectional view of this invention (where the conductive blades are extended outwards).

If a user intends to extend the conductive blades 5 outwards from the apertures 11 formed on the upper case 1, he may manually apply forces to the outer actuators 41 of the push-buttons 4 by pushing or pulling the push-button 4, for guiding the push-buttons 4 to move upwards along the slide slots 23 and slide tracks 21. The inclined guide slots 421 that are attached to the guide posts 311 may thus drive the slider 3 to move upwards at the same time. When the slider 3 continues to move upwards, the free ends of the opposing resilient retaining arms 31 would continue to move upwards and converge towards each other under the influence of the wedge pieces 22 located at the insides of the slide tracks 21 until the push-buttons 4 enter the slide slots 12 of the upper case 1. When the conductive blades 5 are completely extended out of the apertures 11 of the upper case 1, the free ends of the resilient retaining arms 31 happen to completely pass over the tops of the wedge pieces 22. Thus, the free ends of the resilient retaining arms 31 are able to resiliently recover to the tops of stopping faces 221 of the wedge pieces 22 since they are no longer under the influence of the wedge pieces 22 (as shown in FIG. 8). Accordingly, the stopping faces 221 provide stopping effects that prevent the slider 3 from sliding downwards, thereby achieving the objective of locking the slider 3 automatically.

On the other hand, if the user intends to retract and conceal the conductive blades 5 from the extended state, the user may also manually apply forces to the outer actuators 41 of the push-buttons 4 by pushing or pulling the push-buttons 4, for guiding the push-buttons 4 to move downwards along the slide slots 23 and slide tracks 21. At the same time the push-buttons 4 move downwards, the inclined faces of the inclined guide slots 421 would force the free ends of the resilient retaining arms 31 to retract inwards. After the guide posts 311 located on the free ends are completely receded away from the stopping faces 221, the slider 3 may then be driven downwards by the tops of the inclined guide slots 421, thereby achieving the objective of releasing the slider 3 automatically.

What is claimed is:

1. An automatic locking and releasing structure for a push-pull plug, comprising: an upper case, a bottom case, a slider and push-buttons, wherein the upper case is formed with apertures on a top face thereof and a slide slots on opposing sidewalls thereof; the bottom case is suspended therein with two symmetrically arranged slide tracks that are each provided with a wedge piece at a designated location of an inner end thereof, the wedge pieces being each formed with a stopped face on a top thereof, and the bottom case being formed with a slide slot on opposing sidewalls thereof; the slider includes a base for affixing and supporting conductive blades, on opposing sides of the base being each formed with a resilient retaining arm, the resilient retaining arms being each laterally formed with a guide post at a free end thereof; the push-buttons each include an outer actuator and a liner, the outer actuator being provided at an inside thereof with a reduced neck that is connected to the liner, the liners being each provided on opposing sidewalls thereof with inclined guide slots each formed of an inclined configuration;

the slider is first placed in the bottom case and movably provided between the two slide tracks; the reduced necks of the push-buttons are then each engaged into the respective slide slots in such a manner that the liners of the push-buttons each straddle over the respective slide tracks and that the opposing inclined guide slots are movably attached to the guide posts of the respective resilient retaining arms, the upper case is then joined to the bottom case, such that upon pushing and sliding the push-buttons, the inclined guide slots automatically guide the resilient retaining arms to match with the respective wedge pieces thereby assuming a locking or releasing state.

2. The automatic locking and releasing structure for push-pull plug of claim 1, wherein the wedge pieces are each formed of an inclined configuration along an inside of the respective slide tracks.

3. The automatic locking and releasing structure for push-pull plug of claim 1, wherein when the bottom case is joined to the upper case 1, the slide slots align with each other.

4. The automatic locking and releasing structure for push-pull plug of claim 1, wherein the reduced neck has a thickness that adapts to a width of the slide slots of the upper case and bottom case.

5. The automatic locking and releasing structure for push-pull plug of claim 1, wherein the apertures are of a number corresponding to the conductive blades and dimensioned to correspond to the cross-section of the conductive blades.

6. The automatic locking and releasing structure for push-pull plug of claim 1, wherein the resilient retaining arms are each formed at an outside of the slider in an inclined and flared configuration.

* * * * *